US005884516A

United States Patent [19]

Tseng

[11] Patent Number: 5,884,516

[45] Date of Patent: Mar. 23, 1999

[54] THREE DIMENSIONAL COLD FORGING METHOD FOR SHAPING A HOLLOW ARTICLE AND THE APPARATUS FOR THE METHOD

[76] Inventor: Shao-Chien Tseng, No. 130, Sec. 2, Yang-Shin Rd., Yang-Mei, Taoyuan, Taiwan, 326

[21] Appl. No.: 15,043

[22] Filed: Jan. 28, 1998

[51] Int. Cl.[6] ..... B21D 39/08

[52] U.S. Cl. ..... 72/68; 29/421.1; 72/62

[58] Field of Search ..... 72/56, 58, 62; 29/421.1

[56] References Cited

U.S. PATENT DOCUMENTS

| | | | |
|---|---|---|---|
| 2,827,007 | 3/1958 | Wurzburger | 72/58 |
| 4,580,427 | 4/1986 | Akamatsu | 72/62 |
| 4,879,890 | 11/1989 | Hardwick | 72/62 |
| 5,813,266 | 9/1998 | Ash | 72/58 |

*Primary Examiner*—David Jones

*Attorney, Agent, or Firm*—Pro-Techtor Inter-National Services

[57] ABSTRACT

In the method and the apparatus for shaping a hollow article without rough edges, a die protecting member, an inner die, a polyurethane strip, two half die cavities and a freezing medium together form the apparatus; wherein, the inner die having a shape to be given to the article to be forged and having a seamless die cavity is hung in the die protecting member; when in processing, the freezing medium is filled in the die protecting member, so that the inner die is embedded in the freezing medium, fast freeze the die protecting member, the seamless die cavity becomes stiff then, then the metallic blank is put in the cavity, and the polyurethane strip is inserted in the blank, then put the dib protecting member in the half die cavities, a forging press exerts a pressure forwardly on the polyurethane strip which creates thereby an expanding force in the blank, so that the blank can have the shape as that of the seamless die cavity, and the process for shaping the hollow article without rough edges is completed, a metallic pipe workpiece thus can be forged by a cold forging process to get an artistic shape.

5 Claims, 6 Drawing Sheets

THREE DIMENSIONAL COLD FORGING METHOD FOR SHAPING A HOLLOW ARTICLE AND THE APPARATUS FOR THE METHOD

BACKGROUND OF THE INVENTION

1. Field of the Invention

The present invention relates to a three dimensional cold forging method for shaping a hollow article without rough edges and an apparatus for the method, and especially for shaping a thin metallic wall of a blank to be forged, from which a hollow forged art work having a three dimensional shape can be made, and by this method, the strength of the article itself can be enhanced, and more, integrate forging effect wherein seamless or nonrough edge products can be obtained is resulted.

2. Description of the Prior Art

A so-called three dimensional metallic hollow art article means that, the metallic article itself is hollow, while the interior and the exterior walls thereof are both undulated and can be bent randomly in any of the three dimensional directions; the range of raising and depressing (undulating) includes those individual concaved and convex unit walls, and the continuous walls being raised and recessed; the cavities in the unit walls or the continuous walls are communicated with the hollow cavities of the articles; such hollow art works normally are in the shapes of fruits such as grape bunches, star fruits, bananas or balsam pears.

Taking the above stated three dimensional metallic hollow art works as an example, an analysis is done for the cold forging technique in the art and the problems thereof are decribed herebelow:

1) Press forging with a pair of metallic half dies: the cavities of the metallic half dies are provided with separated contact areas, this tends to form on the the surfaces of a workpiece rough edges, and a troublesome polishing after forging is required to eliminate the rough edges, when the contour of the undulated surfaces of the workpiece is overly complicated, it will be very hard to eliminate the rough edges by polishing; if it is desired to form a hollow forged inner wall on the workpiece, a predetermined three dimensional die core must be inserted in the hollow blank in advance, therefore, after press forging of the metallic half dies, the three dimensional die core is unable to be taken out, press forging thus can not be completed.
2) Swaging with drawing force: drawing forging can only be proceeded on the interior and exterior walls with continuous predetermined contours, it can not be proceeded on the walls with independent undulated unit wall decorations.
3) Rotation forging: this is mostly applied on the continuous wall of a blank, it can reach the required three dimensional forging gradually, however, it still can't be applied on the walls with independent undulated unit wall decorations.

The above stated conventional forging techniques are hard to be used to make a three dimensional metallic hollow art work, and under the requirement of getting rid of seams and rough edges, such techniques are even more difficult in forging; yet excavation of die cavities in the conventional forging techniques costs overly high, normally, metallic dies are made of the material better than the medium carbon steel or manganese steel or tungsten steel to be coincident with the strength requirement in die forging, and they can only be used for forging a single article, cost of forging can hardly be reduced.

If the scope of variation of the shape of a hollow metallic article resulted from a forging technique is limited not to broadening, or even an industrial product being required for adequate strength is unable of changing to being artistic, improvement in delicacy of an industrial art work meets a big impedence, the goal of promotion of industy in this art is just hard to be attained.

SUMMARY OF THE INVENTION

Therefore, the principal object of the present invention is to provide a three dimensional forging technique for shaping a hollow metallic article without leaving rough edges, thereby hollow metallic articles having larger scope of variation of shape can be made, and thereby cost of forging can be reduced.

For this purpose, the present invention is provided with the following advantages:

1 . Two hollow plastic housings are formed of PET or PVC plastic material and by the vacuum forming technique (such as the forming technique for a PET bottle) and are a hollow die-protecting member and an inner die; this can lower the cost of manufacturing a die having a die cavity without a seam, and also renders the die cavity to be changeable.
2. The space between the die-protecting member and the wall of the inner die without a seam is filled with mercury of higher specific weight or water solution including cured starch used as a freezing medium, the feature that the mercury or the water solution of the starch can be poured and recollected under normal temperatures as well as that they are provided with stiffness after being frozen make them able of supporting the die cavity for resisting the forging pressure after being frozen, and also is favorable to releasing of the shaped workpiece after defreezing, or for changing the inner die, so that the members and the elements can be recollected for reuse.
3. When liquid mercury or water solution of starch is used as a freezing medium, material such as natural iron sand, iron sand or steel beads can be added thereto and mixed therewith depending on the desired compressive strength of the forging die, to increase the strength of the freezing medium.
4. Based on the law of conservation of energy and by the high plasticity of polyurethane, a polyurethane strip can be inserted in a bore of a workpiece to be forged, the strip is used as a medium for expanding outwardly by swaging of a forging press, such a means of swaging renders the inner and the outer walls of the workpiece to be shaped in three dimensions without a seam.
5. By elastic restoring force of the polyurethane, after removing of the forging press, the polyurethane strip can be taken out of the hollow cavity of the shaped workpiece easily, and the contour of the inner wall can be seen.

The present invention will be apparent in the objects and features thereof after reading the detailed description of the preferred embodiments thereof in reference to the accompanying drawings.

DETAILED DESCRIPTION OF THE PREFERRED EMBODIMENT

Figure 1:
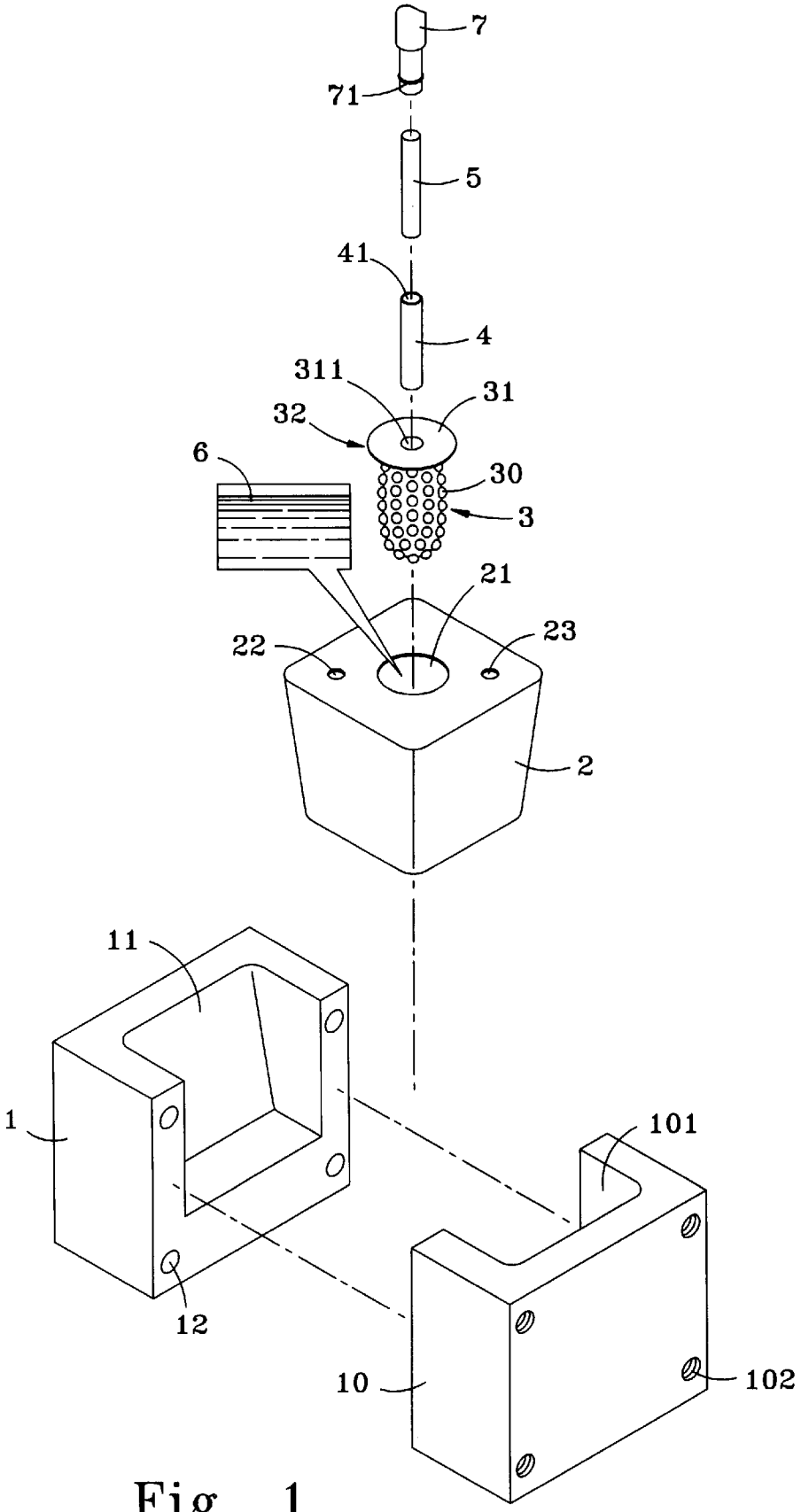
FIG. 1 is a process chart (in a perspective view) of the members as well as the material used in the cold forging process of the present invention.

Referring to the following drawings, the present invention is now described in detail by a preferred embodiment thereof:

As shown in FIG. 1, the members and material used in the cold forging process of the present invention includes two half dies 1 and 10, a die protecting member 2 and an inner die 3, a metallic blank 4, a polyurethane element 5, mercury 6 used as a freezing medium, and a forging press 7 for creating a forwarding action force. Wherein:

The two half dies 1 and 10 which are connectable and separable are made of the material used for making conventional steel dies, the two half dies 1 and 10 together are provided with two half die cavities 11 and 101 capable of receiving the die protecting member 2, the two half die cavities 11 and 101 are opened upwardly, so that the die protecting member 2 can be put at suitable positions in the two half die cavities 11 and 101; the two half dies 1 and 10 are provided peripherally with screw holes 12, 102 for mounting the dies or for guiding and feeding, when in clamping and feeding of the dies, they can hold the periphery and the bottom of the die protecting member 2, and when in opening of the dies, the die protecting member 2 can be released.

The die protecting member 2 made from a PET or PVC plastic shell by vacuum injection moulding is in the form of a rectangular hollow die shield, and is provided on the top thereof with a central inner die insertion hole 21, and is provided at the two sides thereof with an injection hole 22 and a discharge hole 23 for the mercury 6 (freezing medium), the discharge hole 23 can also be used as a pressure releasing port for releasing the gas in the hollow die shield.

Figure 2:
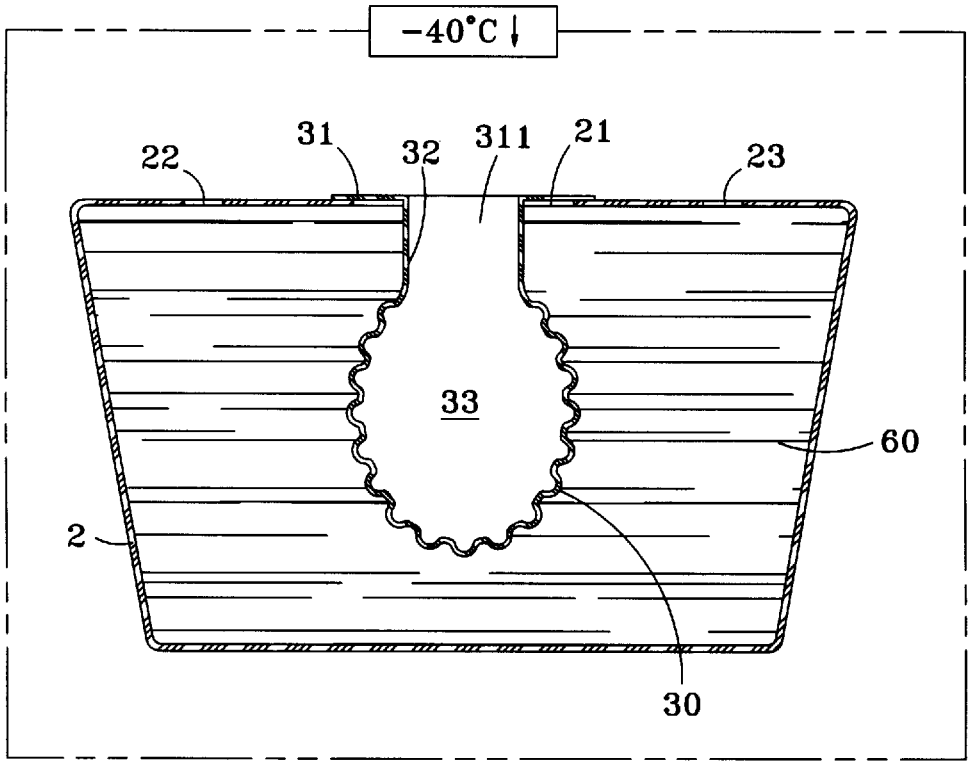
FIG. 2 is a sectional view showing fast freezing of the mercury surrounding the inner die used in the cold forging process of the present invention.

The seamless inner die 3 made from a PET or PVC plastic shell by vacuum injection moulding is manufactured in pursuance of a three dimensional shape, while in this preferred embodiment, the three dimensional inner die 3 is in the artistic shape of a bunch of grapes, wherein, a stop portion 31 must be provided on the top of the inner die 3, a neck 32 (it can be seen clearly in FIG. 2) is provided between the stop portion 31 and the body 30 of the inner die 3, the artistic shape of a bunch of grapes formed by the vacuum injection moulding has on the center of the stop portion 31 a hole 311 which extends into the interior of the body 30 of the inner die 3 to communicate with a seamless die cavity 33 (as shown in FIG. 2), the shape of the wall of the seamless die cavity 33 is identical to the exterior wall of the body 30 of the inner die 3 which is undulated in a three dimensional mode.

The pipe wall of the metallic blank 4 normally is less than 1 mm by thickness, the shape of the metallic blank 4 is optionally in a cup or a pipe shape, a hole 41 is provided at the center of the metallic blank 4.

The polyurethane element 5 is in the form just like that of the hole 41 of the metallic blank 4, but is longer than the hole 41, so that it can be extended into the neck 32 of the inner die 3 after it is inserted in the hole 41.

The shape of the forging press 7 is such that it can be exactly inserted into the hole 41 of the metallic blank 4 a little bit loosely; the forging press 7 can be optionally provided on the periphery wall thereof with a sealing ring for preventing from impediment in leaking of the polyurethane out of the hole 41 through the peripheral wall.

Figure 3:
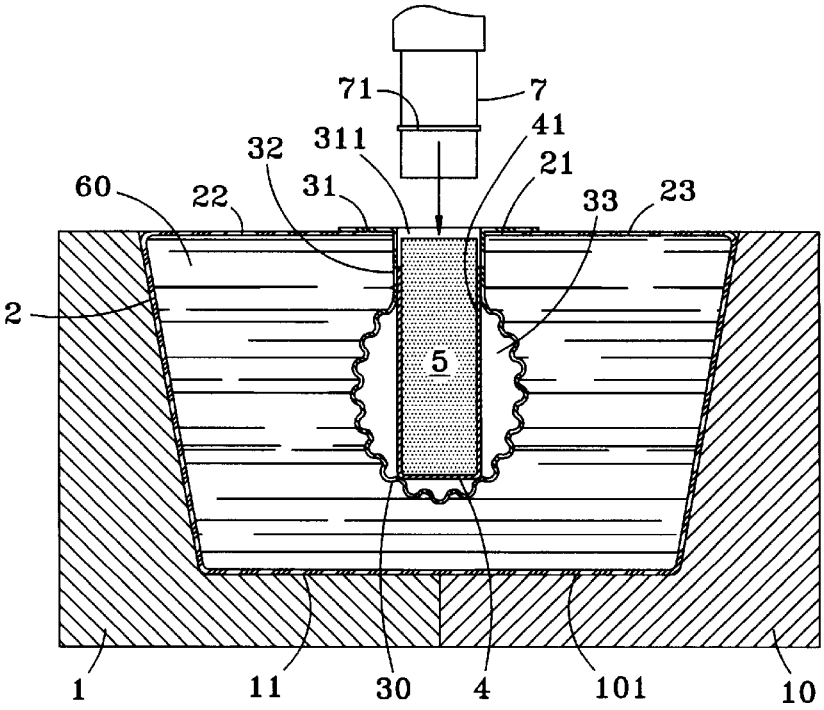
FIG. 3 is a sectional view showing a workpiece to be forged and a polyurethane strip placed in a seamless frozen die cavity during the cold forging process of the present invention.
Figure 4:
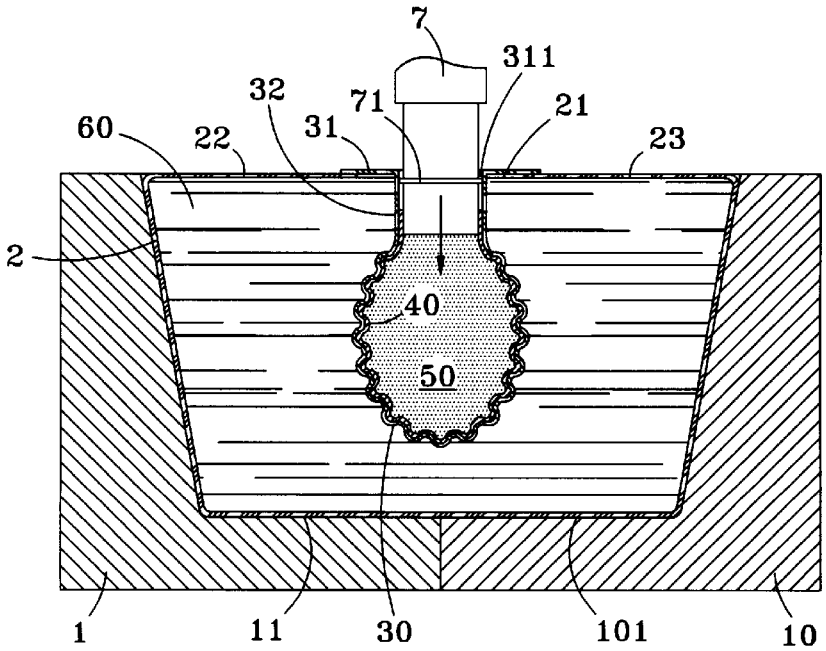
FIG. 4 is a sequential sectional view to FIG. 3 and shows the workpiece being expanded by swaging of a forging press during the cold forging process of the present invention.
Figure 5:
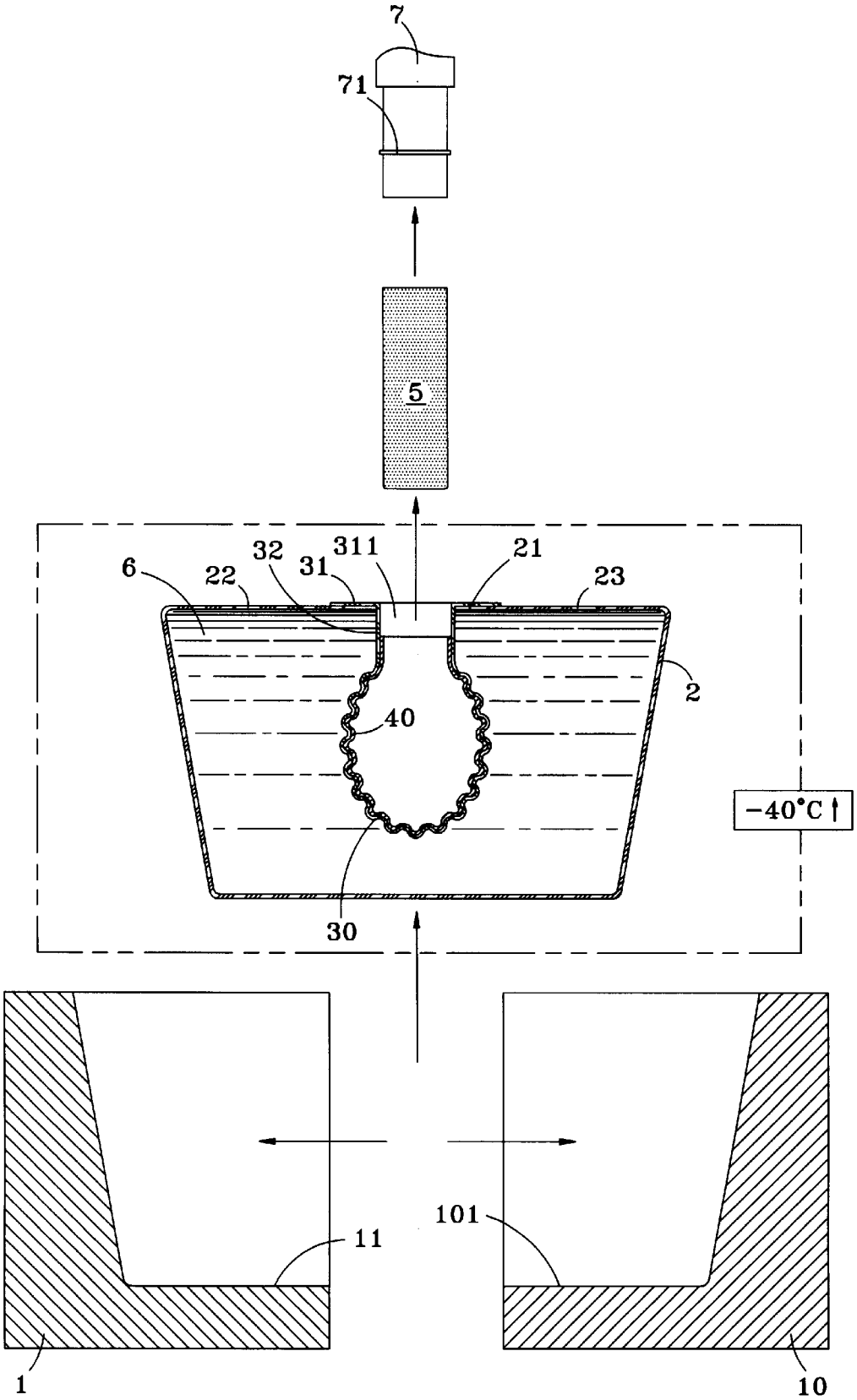
FIG. 5 is a sectional view showing two half dies and the forging press being removed after swaging during the cold forging process of the present invention.
Figure 6:
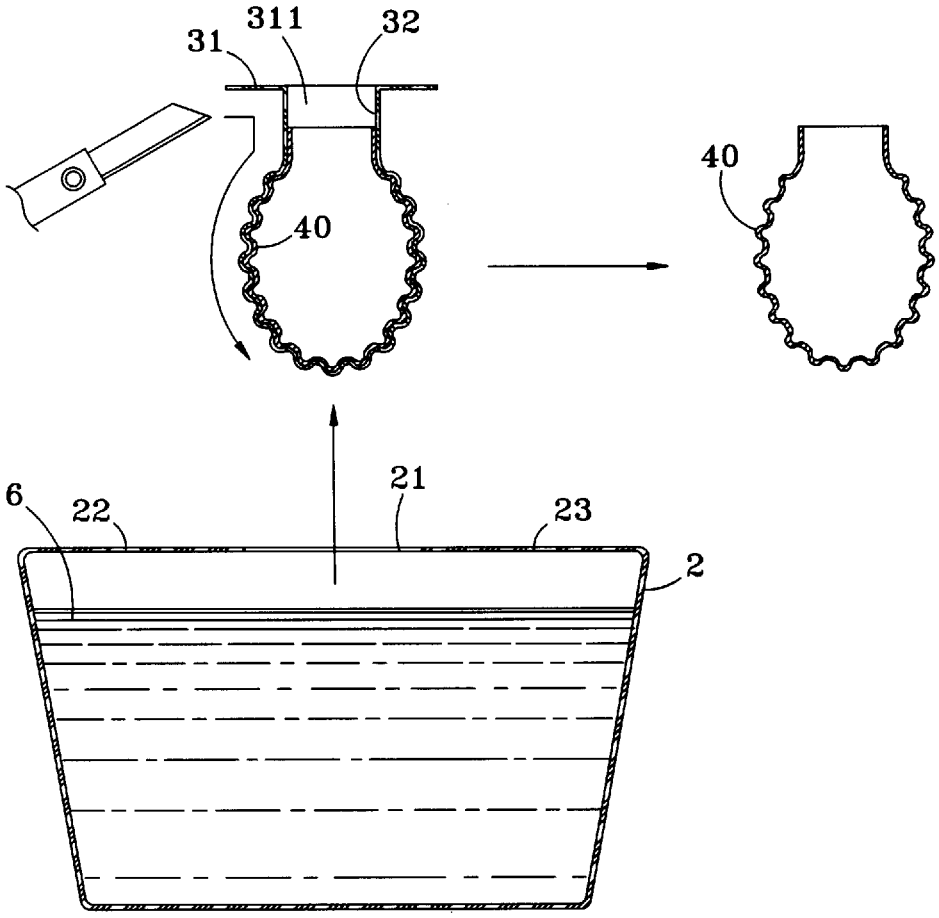
FIG. 6 is a process chart showing the inner die being taken out of a hollow die protecting member and the inner die being removed therefrom a shell during the process of the present invention.
Figure 7:
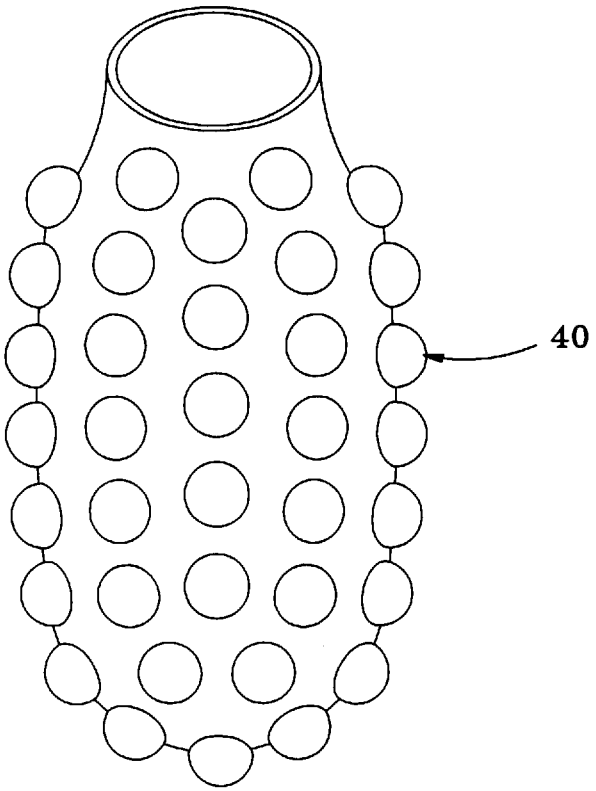
FIG. 7 is a perspective view of the shaped workpiece of the present invention.

It can be seen from the combination of the above stated members as well as material, when in practising of the forging process: such as is shown in FIG. 1 and 2, the body 30 of the inner die 3 is inserted into the die protecting member 2 via the inner die insertion hole 21 of the die protecting member 2; and by the providing that the diameter of the stop portion 31 of the inner die 3 is larger than that of the inner die insertion hole 21, the inner die 3 is hung in the inner die insertion hole 21; then the liquid mercury 6 which is used as a freezing medium is injected into the die protecting member 2 from the injection hole 22 to fully fill all the three dimensional spaces surrounding the body 30 of the inner die 3 and to further fill up to the top level of the neck 32; and then the protecting member 2 is (with the inner die 3 and the liquid mercury 6 therein) fast frozen, due to the fact that the freezing temperature of the liquid mercury 6 is −38.5 C., so that the temperature for fast freezing is set at −40 C., thus the liquid mercury 6 in the protecting member 2 is frozen, now all the continuous and independent three dimensional recesses in the die surfaces of the exterior wall of the body 30 of the inner die 3 are filled with the solidified mercury 60, the solidified mercury 60 or other frozen starch solution has an adequate strength resistable to forging pressure for forging a blank less than 1 mm by thickness (and of course, before being frozen, the mercury or other freezing media can be added thereto mixedable sand or steel beads to increase compressive strength of the frozen medium, however, this belongs to another invention of the present invention, so that it is not narrated further more herein). The die protecting member 2 and the seamless inner die 3 made respectively from a PET or PVC plastic shell is under such a low temperature, and the environment in which the mercury is located is stable, so that the above stated stage of technique can be practised in the industry; thereafter, the frozen die protecting member 2 with the frozen inner die 3 and the liquid mercury 6 therein is placed in the two half dies 1 and 10 which abut against each other (as shown in FIG. 3), and the metallic blank 4 to be forged is placed in the seamless die cavity 33, the polyurethane element 5 has already been put in the hole 41 of the metallic blank 4 with one end thereof inserting appropriately in the neck 32 of the inner die 3;

the forging press 7 then is aligned with the insertion hole 21 and a forging pressure is forwardly exerted on the other end of the polyurethane element 5 (as shown in FIG. 4), so that the wall of the metallic blank 4 bears the equally distributed swaging force of the polyurethane strip 5 exerting outwardly from inside thereof, and forms the seamless die cavity 33; after swaging, the forging press 7 and the two half dies 1 and 10 are removed (as shown in FIG. 5). At this time, the polyurethane element 5 which has been pressed by forging pressure restores by elasticity thereof to its original shape, so that it can be taken out of the central chamber of the completed work-piece 40, meantime, the temperature of the frozen die protecting member 2 does not make the freezing medium (such as the solidified mercury 60) dissolve to raise the temperature thereof to the freezing temperature (such as −38.5 C. for the solidified mercury 60); and then appropriate hot temperature (lower than the melting temperature of the PET and PVC) is applied to the frozen die protecting member 2, so that the mercury therein is defrozen to a liquid state 6, and the inner die 3 hung in the frozen die protecting member 2 is loosened and is taken out, also the hollow shaped workpiece 40 therein can be taken out (as shown in FIG. 6). A knife 8 is then used to cut and remove the shell of the inner die 3, this makes the shaped hollow workpiece 40 able to be taken out and thus reveals the three dimensional non rough-edge as well as seamless die cavity 33 of the shaped hollow workpiece 40 (as shown in FIG. 7).

The embodiment of the shaped hollow workpiece 40 forged by the present invention is not limited to the shape of a bunch of grapes, the thickness of the wall of the workpiece 40 is not limited by the shape of this embodiment, more, the freezing medium can also include the water solution of starch; the three dimensional non roughedge forging technique for a hollow workpiece can be applied to the techniques in the field which have not been capable of forging a hollow metallic workpiece, and can have an effect of leaving no rough edge nor seam; the present invention is a high grade cold forging technique, can increase the scope of variation of shape and delicacy of the surfaces of the hollow workpieces.

Having thus described my invention, what I claim as new and desire to be secured by Letters Patent of the United States is:

1. A three dimensional cold forging method for shaping a hollow metallic article comprising the steps of:

(a) hanging a hollow inner die comprising a hollow plastic shell in a die protecting member, (b) injecting a liquid freezing medium into said die protecting member to surround a body of said inner die, (c) fast freezing said die protecting member with said hollow inner die and said liquid freezing medium therein, a temperature for fast freezing is lower than a freezing temperature of said liquid freezing medium, so that said liquid freezing medium in said protecting member is frozen, thereby stiffening an exterior wall of said inner die, (d) placing said frozen die protecting member into a pair of half dies which abut each other, (e) placing a metallic article to be forged into a seamless die cavity of said inner die, a polyurethane element having been placed into a hole of the metallic article with one end of said polyurethane element in a neck of said inner die, (f) exerting by means of a forging press a forging pressure on a second end of said polyurethane element, so that a wall of said metallic article bears the equally distributed swaging force of said polyurethane element so that said metallic article conforms to the shape of said seamless die cavity, (g) removing said forging press and said two half dies from said inner die so that said polyurethane element which has been deformed by forging pressure is restored by elasticity to its original shape and can be removed from said inner die, (h) raising the temperature of said freezing medium which is thereby thawed into a liquid state, allowing said inner die hung in said die protecting member to be loosened and removed, (i) cutting and removing said shell of said inner die, thereby allowing removal of the metallic article.

2. The three dimensional cold forging method for shaping a hollow metallic article without rough edges as defined in claim 1 wherein: in step (h), the temperature is not raised above a melting point of the material forming said shell of said inner die.

3. A three dimensional cold forging device for shaping a hollow metallic article without rough edges comprising:

a pair of steel half dies, a die protecting member, an inner die comprising a hollow plastic shell, a polyurethane element, liquid mercury or a cured starch water solution used as a freezing medium, and a forging press to create a forging pressure; wherein, said inner die comprises a seamless die cavity, inner and outer walls of said die cavity include a desired three dimensional design for the article to be forged, and said die protecting member is in the form of a rectangular hollow die shield, and is provided on the top thereof with a central inner die insertion hole, and is provided at the two sides thereof with an injection hole and a discharge hole for said freezing medium, and a stop portion is provided on the top of said inner die, a neck is provided between said stop portion and the body of said inner die, said stop portion has on the center thereof a hole which extends into the interior of said body of said inner die to communicate with said seamless die cavity, and said polyurethane element is is received in a hole of said metallic article, said polyurethane element is longer than said hole, so that said polyurethane element extends into said neck of said inner die.

4. The three dimensional cold forging device for shaping a hollow metallic article without rough edges as defined in claim 3 wherein:

said discharge hole for said die protecting member, in addition to discharging said freezing medium, is also used as a pressure releasing port for releasing gas from said hollow die shield.

5. The three dimensional cold forging device for shaping a hollow metallic article without rough edges as defined in claim 3 wherein:

the diameter of said stop portion of said inner die is larger than that of said inner die insertion hole.

* * * * *